US006053365A

United States Patent [19]

O'Mara et al.

[11] Patent Number: 6,053,365

[45] Date of Patent: Apr. 25, 2000

[54] TEXTURE PUMP AND CLEANER ASSEMBLY

[75] Inventors: John E. O'Mara, Conway Springs; Robert E. O'Mara, Wichita, both of Kans.

[73] Assignee: Rimfire Management Corporation, Winfield, Kans.

[21] Appl. No.: 08/935,719

[22] Filed: Sep. 23, 1997

[51] Int. Cl.[7] ..... B67D 1/08

[52] U.S. Cl. ..... 222/148; 222/608

[58] Field of Search ..... 222/148, 256, 222/262, 340, 527, 384, 153.13, 608

[56] References Cited

U.S. PATENT DOCUMENTS 5,544,791 8/1996 Chih ..... 222/262

5,878,925 3/1999 Denkins et al. ..... 222/608

*Primary Examiner*—Philippe Derakshani

*Attorney, Agent, or Firm*—James E. Bradley

[57] ABSTRACT

A mud texture system has a cart with a mud tank assembly, a mud pump, a water tank and a water pump. The mud tank assembly includes a mud tank and, in one version, a manual piston assembly. The piston assembly slides against the wall of the mud tank to scrape the mud downward into the mud pump. The mud pump supplies pressurized mud into a hose for dispensing with an applicator. The water pump pumps water from the water tank to rinse out the hose, applicator, mud tank and other tools. In another version, the mud tank assembly has motor which drives a vertical shaft in the mud tank. The shaft drives a set of mixing paddles in the mud tank to mix and force mud to the mud pump. The mud pump continuously supplies pressurized mud to a mud hose and applicator where the level of mud flow is controlled.

16 Claims, 4 Drawing Sheets

47
26
4
20
18
16
22
13
52
53
12
14
27
24
26
44
46
42
30
34
38
40
6
36

TEXTURE PUMP AND CLEANER ASSEMBLY

TECHNICAL FIELD

This invention relates in general to drywall equipment and in particular to a improved drywall mud pump.

BACKGROUND ART

Drywall mud texture is applied to joints of drywall to give them a smooth, continuous finish. The application of drywall mud typically requires large pieces of equipment including a mud tank which is hauled on trucks to the work site. The equipment is routinely left outside the structure being drywalled. After each day's use, the equipment, particularly the mud tank, must be cleaned with pressurized water. This operation usually involves another piece of equipment. A less cumbersome, portable mud texture system is desirable.

DISCLOSURE OF INVENTION

A mud texture system has a cart with a mud tank assembly, a mud pump, a water tank and a water pump. The mud tank assembly includes a mud tank and, in one version, a manual piston assembly. The piston assembly slides against the wall of the mud tank to scrape the mud downward into the mud pump. The mud pump supplies pressurized mud into a hose for dispensing with an applicator. The water pump pumps water from the water tank to rinse out the hose, applicator, mud tank and other tools. In another version, the mud tank assembly has a motor which drives a vertical shaft in the mud tank. The shaft drives a set of mixing paddles in the mud tank to mix and force mud to the mud pump. The mud pump continuously supplies pressurized mud to a mud hose and applicator where the level of mud flow is controlled.

BEST MODE FOR CARRYING OUT THE INVENTION

Figure 1:
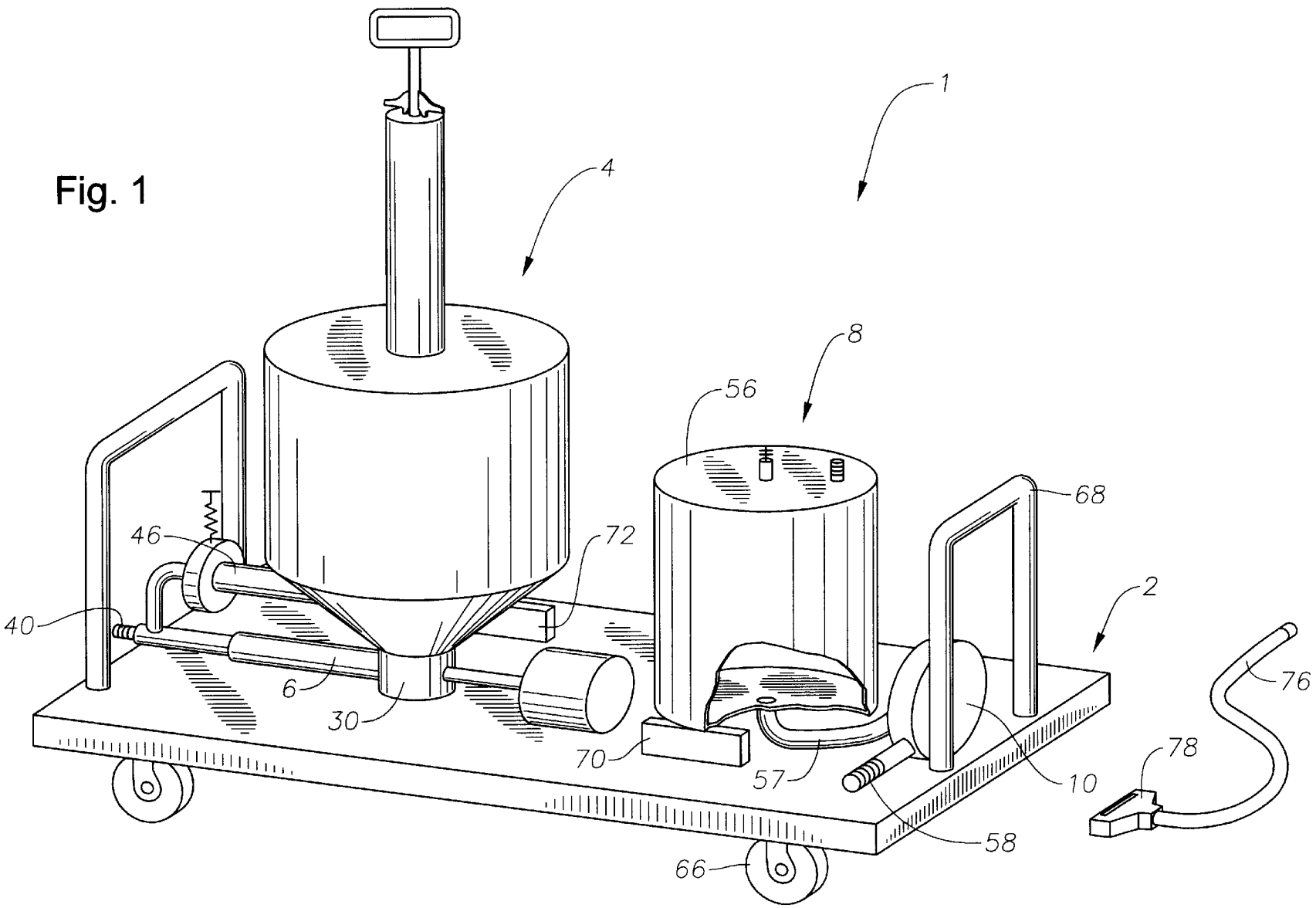
FIG. 1 is a perspective view illustrating a texture pump assembly in accordance with this invention, including a water tank, mud tank and both pumps, all mounted to the cart, omitting the front mud tank bracket.

Referring to FIG. 1, the texture system 1 includes a cart 2, on which are mounted a mud tank assembly 4, a progressive cavity pump 6, a water tank assembly 8 and a centrifugal pump 10. In this description, "mud" refers to the texture material used to fill gaps between wall board panels.

Figure 2:
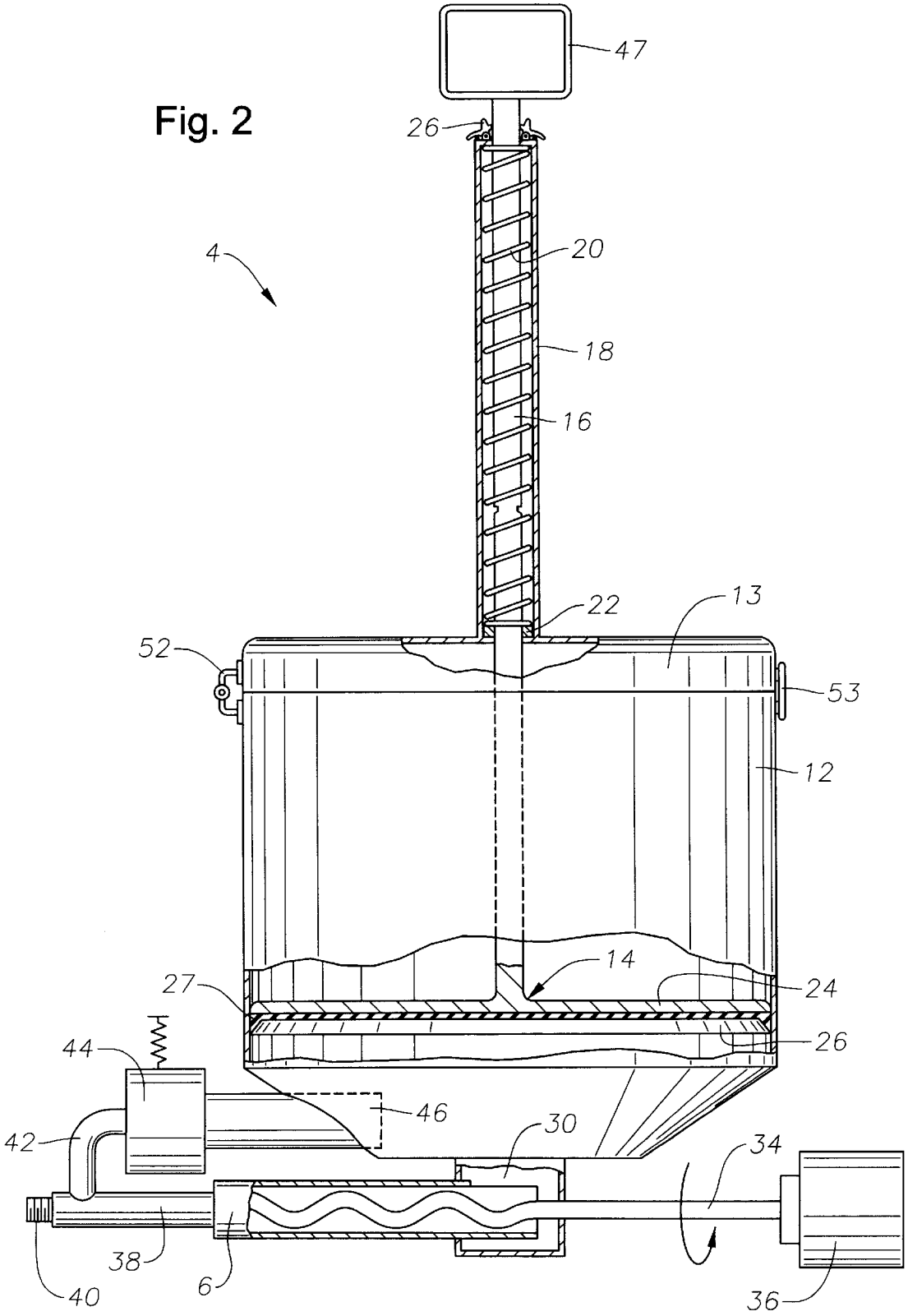
FIG. 2 is an elevational view of the texture pump assembly of FIG. 1, showing the mud tank assembly and progressive cavity pump in partial section and the piston assembly in extended position.

Referring to FIG. 2, mud tank assembly 4 includes a mud tank 12, a mud tank cover 13 and a piston assembly 14. Piston assembly 14 includes a push rod 16 that runs internally down the length of a spring shaft 18 which is affixed to the top of mud tank cover 13. A compression spring 20 is encased within the inside of spring shaft 18 and surrounds push rod 16. The compression spring 20 acts on the top end of spring shaft 18; the opposite end of compression spring 20 acts on the push plate 22. Push plate 22 is fixed to push rod 16, which extends down through the top of mud tank cover 13 and into the inside of mud tank 12. At that end, piston assembly 14 terminates in a piston plate 24 on which is affixed a piston gasket 26.

Compression spring 20, acting upon push plate 22, slides against the wall of mud tank 12 and forces piston assembly 14 down onto the mud. Piston gasket 26 has a scraper edge 27 which ensures that as piston assembly 14 is pushed downward, the mud clinging to the walls of mud tank 12 is made available to the system. To provide pressurized mud, the mud is allowed to flow into an intake chamber or manifold 30 into which progressive cavity pump 6 extends. Progressive cavity pump 6 is powdered via a drive shaft 34 by a pump motor 36. Progressive cavity pump 6 supplies pressurized mud into a supply line 38, and makes it available at a mud supply fitting 40 via a hose 76 for use by an applicator 78 (both shown at FIG. 1). As the device is designed, progressive cavity pump 6 will operate continuously. Thus, when there is no demand for the mud at applicator 78, there must be a means of relieving the pressurized mud back into mud tank 12. In order to accomplish this, there is a return line 42 which feeds through a pressure relief valve 44 and thence through a return inlet 46 back into mud tank 12.

The opposite end of piston assembly 14 extends through the top of spring shaft 18 and terminates in a handle 47. Handle 47 may be used to pull upward on the piston assembly 14, thereby retracting the opposite end of piston assembly 14 into the inner part of mud tank cover 13.

Figure 3:
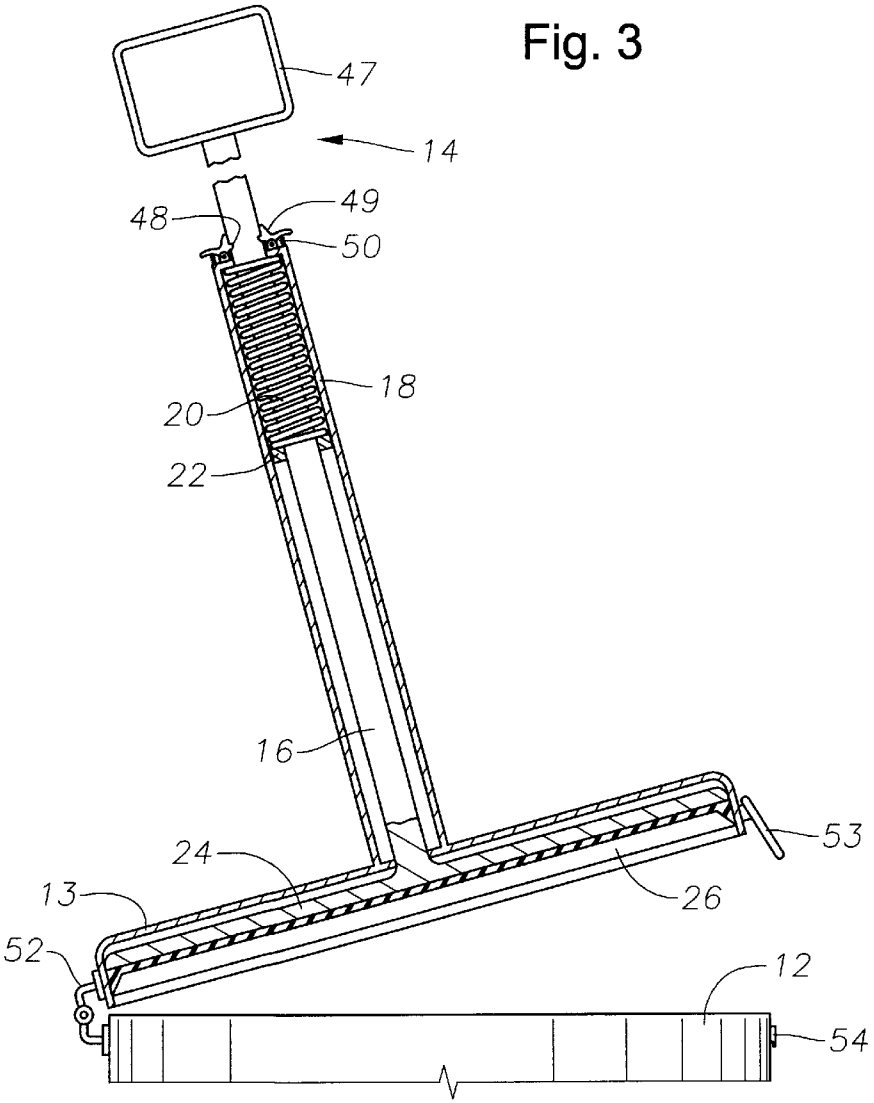
FIG. 3 is a plan view of the texture pump assembly of FIG. 1, showing details of mud tank cover and piston assembly locked in retracted position, both being partial section views.

Referring to FIG. 3, because compression spring 20 will continue to act on push plate 22, tending to return piston assembly 14 to the extended position, there are two detents 48 cut into push rod 16 which allow two catches 49 to lock push rod 16 into the retracted position and thus prevent piston assembly 14 from returning to the extended position. A catch return spring 50 forces catch 49 to lock into detent 48 when catch 49 and detent 48 have reached the proper position opposite one another.

Mud tank cover 13 is fixed to mud tank 12 by a hinge 52, and is secured by a mud tank latch 53, which hooks about a mud tank latch hook 54. Once the mud tank cover 13 is secure, catches 49 can be released from detentes 48.

Figure 4:
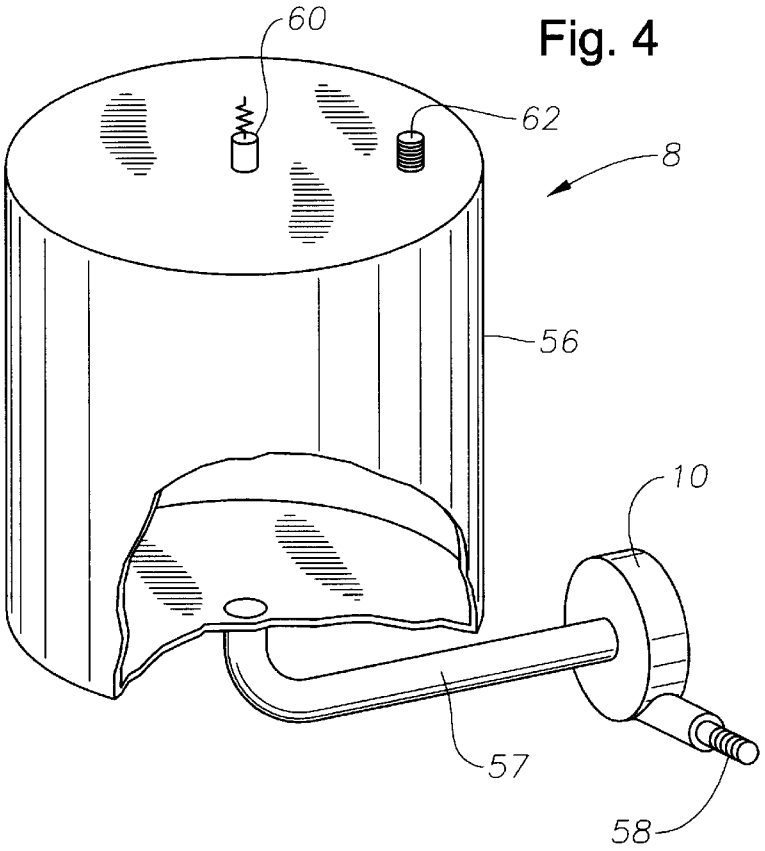
FIG. 4 is a perspective view illustrating the water tank and centrifugal pump of the texture pump assembly of FIG. 1.

Referring to FIG. 1, the invention also provides a water tank assembly 8 which allows the user to rinse out hose 76 and also applicator 78 in order to keep the mud from hardening within them, as well as to clean up any other dirty tools. Referring to FIG. 4, water tank assembly 6 includes a water tank 56, and a water feed line 57, mounted below water tank 56, that provides water to a centrifugal pump 10. Centrifugal pump 10 provides water to hose 76 via a water supply fitting 58. While in operation, a vent valve 60 allows the level of water in water tank 56 to drop without excessive back-pressure. There is also a water tank inlet fitting 62 which allows a water hose (not shown) to be screwed onto the top of water tank 56 in order to fill it.

Returning to FIG. 1, both water tank assembly 8 and mud tank assembly 4 are mounted on a cart 2, which has four wheels 66, each located near a corner, and is provided with two cart handles 68. Water tank 56 is mounted on two water tank brackets 70 to provide room for water feed line 57. Similarly mud tank 12 is mounted on two mud tank brackets 72 in order to provide room for progressive cavity pump 6, manifold 30, and return inlet 46 mounted beneath it. Texture system 1 is able to provide pressurized mud to hose 76 and to applicator 78, via mud supply fitting 40, or water to hose 76 via water supply fitting 58.

Referring back to FIG. 3, in order to use the invention, the user will first open mud tank cover 13 in order to put texture material, or mud, into mud tank 12. To do so without damaging the device, the user must first use handle 47 to pull upward on piston assembly 14, thereby retracting the opposite end of piston assembly 14 into the inner part of mud tank cover 13. Because compression spring 20 will continue to act on push plate 22 and tend to return piston assembly 14 to the extended position, the user must pull handle 47 until catches 49 catch onto detents 48 cut into push rod 16, which will lock push rod 16 into the retracted position, and thus prevent piston assembly 14 from returning to the extended position. If piston assembly 14 were to be in the extended position when mud tank cover 13 were opened, it would result in the bending of push rod 16.

The user will then undo mud tank latch 53 from mud tank latch hook 54, allowing the mud tank cover 12 to open about hinge 52. Once mud tank 12 is filled with mud, the user will close mud tank cover 13, and latch it down, using mud tank latch 53, and mud tank latch hook 54. At this time, catches 49 may be released so that piston assembly 14 scrapes the mud off of the inner walls and down into mud tank 12.

Turning to FIG. 2, by running progressive cavity pump 6, and attaching hose 76 to outlet supply fitting 40, and the applicator 78 to hose 76, the user has pressurized mud available.

In a clean-up operation, mud tank 12 may be rinsed by removing hose 76 from fitting 40 and reconnecting it to fitting 58 on water tank 56. Water is then pumped through hose 76 by centrifugal pump 10 to clean off any residual mud on the walls inside mud tank 12 and its components. The water flowing through hose 76 and applicator 78 clean them as it flows through. The operator will normally direct the water into mud tank 12, leaving a layer of water on top of the mud.

Figure 5:
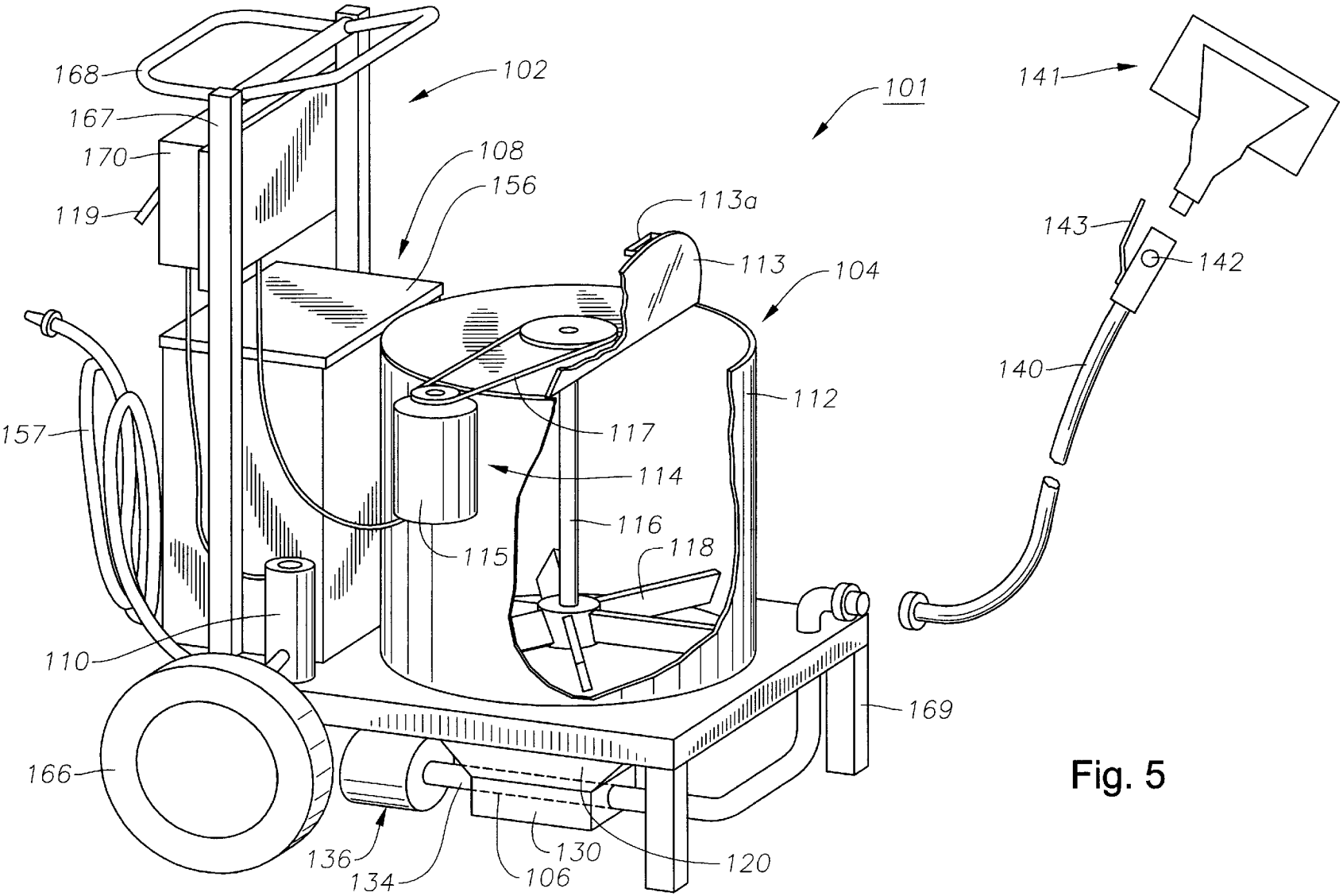
FIG. 5 is a perspective view of a second embodiment of the mud pump.

Referring to FIG. 5, a second embodiment of the mud pump is shown. Texture system 101 includes a modified dolly 102 on which is mounted a mud tank assembly 104, a progressive cavity pump 106, a water tank assembly 108 and a centrifugal pump 110.

Mud tank assembly 104 includes a mud tank 112, a mud tank cover 113 with a handle 113*a*, and a motor assembly 114. Motor assembly 114 includes a motor 115 and a shaft 116 which runs internally down the center of mud tank 112. Motor 115 is connected to an upper end of shaft 116 with a gear and chain arrangement 117. A plurality of mixing paddles 118 extend radially from a lower end of shaft 116 at the bottom of tank 112. Paddles 118 have axes which are perpendicular to shaft 116 and are symmetrically spaced apart. Paddles 118 also have generally planar surfaces which are biased or tapered vertically downward for creating pressure on the mud toward a hopper 120 at the bottom of tank 112. Paddles 116 are controlled by an on/off switch 119 at the upper end of dolly 102.

Motor 115 rotates shaft 116 and paddles 118 to mix and force mud downward into hopper 120. The mud is allowed to flow into an intake chamber or manifold 130 into which progressive cavity pump 106 extends. Progressive cavity pump 106 is powered via a drive shaft 134 by a pump motor 136. Progressive cavity pump 106 continuously supplies pressurized mud to a hose 140 and applicator 141. Hose 140 has a remote control valve 142 at a distal end which allows the user to select the level of mud flow from applicator 141. An on/off handle 143 is adjacent to valve 142 for initiating and halting the flow of mud through valve 142. In the embodiment shown, applicator 141 comprises a mud wipe-down floater. In alternate embodiments (not shown), applicator 141 may comprise, for example, a combination joint tape/wipe down floater or an acoustic sprayer. When on/off handle 143 is depressed, mud is dispensed. When on/off handle 143 is released, mud flow is discontinued.

Water tank assembly 108 allows the user to clean the equipment and supply dilution water to mud tank 112. Water tank assembly 108 includes a water tank 156 and a hose 157 mounted behind tank 156. Centrifugal pump 110 pumps water from tank 156 to hose 157. Dolly 102 has two wheels 166, a pair of long vertical frame supports 167 on a rearward end, and a pair of short vertical frame supports 169 on a forward end. Dolly 102 also has two handles 168 and an electrical control box 170 for texture system 101 at an upper end of long supports 167.

Texture system 101 operates similarly to texture system 1. Mud tank 112 is filled with mud which is forced downward, out of mud tank 112 into hopper 120. Pump 106 then pumps the mud through hose 140 to applicator 141 where the flow of mud is controlled. Water tank assembly 108 may be used to clean mud tank 112. Pump 110 pumps water from water tank 156 to hose 157 where it is used to rinse mud tank 112 of residual mud. The water flowing through hose 140 and applicator 141 clean them as it flows through. The operator will normally direct the water into mud tank 112, leaving a layer of water on top of the mud.

The invention has several advantages. Each embodiment of the texture system is a relatively small, completely portable, self-contained unit for dispensing mud, and has a water tank for diluting the mud and for clean-up.

While the invention has been shown in only some of its forms, it should be apparent to those skilled in the art that it is not so limited, but is susceptible to various changes without departing from the scope of the invention.

We claim:

1. A portable drywall mud texture pump and cleaning assembly for supplying mud to a drywall applicator, comprising:

a cart having a plurality of wheels mounted to a lower side and a handle for manipulating the cart;

a mud tank mounted to the cart and having an outlet;

a feed mechanism located substantially within the mud tank for feeding mud to the outlet;

a mud pump for pumping mud from the outlet to the applicator;

a water tank mounted to the frame; and a water pump for pumping water from the water tank for clean-up and for diluting mud in the mud tank.

2. The portable drywall mud texture pump and cleaning assembly of claim 1 wherein the feed mechanism comprises a manual push rod extending through the mud tank, and a piston plate secured to a lower end of the push rod for sliding against an inner wall of the mud tank and feeding mud to the outlet.

3. The portable drywall mud texture pump and cleaning assembly of claim 1 wherein the feed mechanism comprises a motor-driven set of blades located in the mud tank, the blades being inclined to push the mud toward the outlet.

4. The portable drywall mud texture pump and cleaning assembly of claim 1 wherein the feed mechanism comprises a scraper blade.

5. The portable drywall mud texture pump and cleaning assembly of claim 1 wherein the mud pump is a progressive cavity pump.

6. The portable drywall mud texture pump and cleaning assembly of claim 1 wherein the water pump comprises a centrifugal pump.

7. A portable drywall mud texture pump and cleaning assembly for supplying mud to a drywall applicator, comprising:

a cart having a plurality of wheels mounted to a lower side and a handle for manipulating the cart;

a mud tank mounted to the cart;

a manual push rod extending vertically through the mud tank, and a piston plate secured to a lower end of the push rod for sliding against an inner wall of the mud tank;

a spring for urging the piston plate downward for pressurizing the mud within the mud tank;

a mud pump mounted to the cart for pumping mud from the mud tank;

a water tank mounted to the cart; and a water pump for pumping water from the water tank.

8. The portable drywall mud texture pump and cleaning assembly of claim 7, further comprising a hose which may be connected to the mud pump for supplying mud from the mud pump to the applicator, and which may be connected to the water pump for dispensing water from the water pump.

9. The portable drywall mud texture pump and cleaning assembly of claim 7 wherein the mud pump is a progressive cavity pump.

10. The portable drywall mud texture pump and cleaning assembly of claim 7 wherein the water pump comprises a centrifugal pump.

11. The portable drywall mud texture pump and cleaning assembly of claim 7, further comprising:

a return line between an outlet of the mud pump and the mud tank; and a pressure relief valve in the return line for selectively controlling the release of mud back into the mud tank.

12. A portable drywall mud texture pump and cleaning assembly for supplying mud to a drywall applicator, comprising:

a cart having frame, a plurality of wheels mounted to a lower side of the frame and a handle for manipulating the cart;

a mud tank mounted to the frame;

a motor-driven set of blades located in the mud tank, the blades having a downward bias for pressurizing the mud in the mud tank;

a mud flow line in communication with the mud tank;

a mud pump for pumping mud from the mud tank through the mud flow line to the applicator;

a water tank mounted to the frame; and a water pump for pumping water from the water tank for clean-up and for diluting mud in the mud tank.

13. The portable drywall mud texture pump and cleaning assembly of claim 12, further comprising a water hose in communication with the water tank.

14. The portable drywall mud texture pump and cleaning assembly of claim 12 wherein the mud pump is a progressive cavity pump.

15. The portable drywall mud texture pump and cleaning assembly of claim 12 wherein the water pump comprises a centrifugal pump.

16. The portable drywall mud texture pump and cleaning assembly of claim 12, further comprising a handle on an outlet end of the mud flow line, the handle comprising:

a valve for selectively controlling the rate of mud flow from the applicator; and an on/off switch for controlling the release of mud to the valve.

* * * * *